US009227817B2

(12) United States Patent
Fauconnet et al.

(10) Patent No.: US 9,227,817 B2
(45) Date of Patent: Jan. 5, 2016

(54) TOE GUARD ASSEMBLY FOR AN ELEVATOR SYSTEM

(75) Inventors: Aurelien Fauconnet, Isdes (FR); Etienne Delachatre, Saint Benoit (FR)

(73) Assignee: Otis Elevator Company, Farmington, CT (US)

( * ) Notice: Subject to any disclaimer, the term of this patent is extended or adjusted under 35 U.S.C. 154(b) by 129 days.

(21) Appl. No.: 14/006,202

(22) PCT Filed: Mar. 22, 2011

(86) PCT No.: PCT/IB2011/001162

§ 371 (c)(1), (2), (4) Date: Sep. 19, 2013

(87) PCT Pub. No.: WO2012/127269

PCT Pub. Date: Sep. 27, 2012

(65) Prior Publication Data

US 2014/0008158 A1 Jan. 9, 2014

(51) Int. Cl.
*B66B 13/28* (2006.01)

(52) U.S. Cl.
CPC ..... *B66B 13/285* (2013.01)

(58) Field of Classification Search
CPC ..... B66B 13/245; B66B 13/285
See application file for complete search history.

(56) References Cited

U.S. PATENT DOCUMENTS

| | | | | |
|---|---|---|---|---|
| 1,738,729 | A * | 12/1929 | Richardson | 187/414 |
| 4,457,403 | A | 7/1984 | Ream | |
| 5,490,758 | A | 2/1996 | Stone | |
| 5,655,628 | A * | 8/1997 | Lin | 187/414 |
| 6,095,288 | A * | 8/2000 | Rivera et al. | 187/343 |
| 7,350,627 | B2 * | 4/2008 | Ketonen et al. | 187/400 |
| 7,779,967 | B2 | 8/2010 | Kocher et al. | |
| 8,469,155 | B2 * | 6/2013 | Thomsen et al. | 187/401 |
| 2007/0181377 | A1 | 8/2007 | Ketonen et al. | |
| 2008/0230327 | A1 | 9/2008 | Cabanas Falcon et al. | |
| 2009/0277725 | A1 | 11/2009 | Rasanen et al. | |
| 2009/0301821 | A1 | 12/2009 | Fujiki et al. | |
| 2010/0155184 | A1 | 6/2010 | Sirigu et al. | |
| 2014/0020986 | A1 * | 1/2014 | Delachatre et al. | 187/400 |
| 2014/0216860 | A1 * | 8/2014 | Karimpanackal Natarajan et al. | 187/400 |

FOREIGN PATENT DOCUMENTS

| | | | |
|---|---|---|---|
| CN | 1942386 | A | 4/2007 |
| CN | 101304937 | A | 11/2008 |
| DE | 10065101 | A1 | 7/2002 |

(Continued)

OTHER PUBLICATIONS

DE10065101 English Translation.pdf.*
Supplementary European Search Report for Application No. EP 11 86 1598 dated Nov. 24, 2014.

(Continued)

*Primary Examiner* — William E Dondero
*Assistant Examiner* — Minh Truong
(74) *Attorney, Agent, or Firm* — Carlson, Gaskey & Olds

(57) ABSTRACT

An exemplary elevator toe guard assembly includes a first panel. A second panel is slidable relative to the first panel in a first direction between an extended position and a retracted position. The first panel moves in a second, different direction from an extended position toward a folded position responsive to the second panel moving toward the retracted position.

18 Claims, 5 Drawing Sheets

(56) References Cited

FOREIGN PATENT DOCUMENTS

| | | | |
|---|---|---|---|
| EP | 1118576 | A2 | 7/2001 |
| EP | 1524234 | A1 | 4/2005 |
| EP | 2042463 | A1 | 4/2009 |
| EP | 2308789 | A1 | 4/2011 |
| JP | 2002302370 | A | 10/2002 |
| WO | 2008110696 | A1 | 9/2008 |

OTHER PUBLICATIONS

International Search Report and Written Opinion of the International Searching Authority for International application No. PCT/IB2011/001162 dated Dec. 23, 2011.

State Intellectual Property Office of People's Republic China, First Search, Application No. 201180069397.4 dated Feb. 12, 2015.

* cited by examiner

TOE GUARD ASSEMBLY FOR AN ELEVATOR SYSTEM

BACKGROUND

Elevator cars typically include a toe guard situated beneath the elevator car. The toe guard is typically rigid and almost one meter in length. Some toe guards are up to two meters in length. A significant amount of clearance beneath the elevator car is therefore required to avoid bumping the toe guard against the bottom of the shaft when the elevator car is situated at a lowest landing.

Elevator systems have included a pit at the bottom of the hoistway, in part, to provide sufficient clearance between the bottom of the elevator car and the bottom of the hoistway. Typical pit configurations provide a sufficient clearance for typical toe guards. More recently, however, elevator pits have been eliminated or reduced in size. Conventional toe guards do not allow for elevator cars in such systems to travel as low as necessary.

One suggestion for addressing such a situation is shown in U.S. Pat. No. 6,095,288. That document includes a toe guard panel that is moveable from a position where the toe guard extends vertically downward from the elevator car into a position where the toe guard is tucked beneath the elevator car in a nearly horizontal orientation.

SUMMARY

An exemplary elevator toe guard assembly includes a first panel. A second panel is slidable relative to the first panel in a first direction between an extended position and a retracted position. The first panel moves in a second, different direction from an extended position toward a folded position responsive to the second panel moving toward the retracted position.

In one assembly consistent with that of the previous paragraph, the second panel is telescopically moveable relative to the first panel and the second panel moves with the first panel in the second direction.

In an example assembly consistent with either of the preceding paragraphs, the second panel is supported beneath the first panel in the extended position and at least partially overlaps the first panel in the extended and the retracted position.

In an example assembly consistent with any of the preceding three paragraphs, a contactor is supported beneath the second panel. The contactor is configured to contact the surface beneath the panels as the assembly moves vertically downward. The second panel moves from the extended position toward the retracted position responsive to such contact.

In an example assembly consistent with any of the preceding four paragraphs, a folding mechanism facilitates the panels moving between the extended position and the folded position. An instigator is supported on the second panel. The instigator instigates folding the folding mechanism.

An example assembly consistent with any of the preceding five paragraphs includes the first panel pivotally supported near a first end of the first panel. The folding mechanism is connected to the first panel near a second, opposite end of the first panel. The first panel pivots about a pivot point near the first end when moving between the extended and folded positions.

An example assembly consistent with any of the preceding six paragraphs includes a contact surface on the instigator that contacts a portion of the folding mechanism as the second panel moves relative to the first panel. Contact between the contact surface and the folding mechanism results in the portion of the folding mechanism urging the first panel toward the first position.

An example assembly consistent with any of the preceding seven paragraphs includes the contact surface at least partially transverse to the second panel near one end of the second panel. Contact between the contact surface and the portion of the folding mechanism occurs as the second panel approaches the retracted position.

An example assembly consistent with any of the preceding eight paragraphs includes the contact surface being situated on the second panel such that the second panel continues to move into the retracted position after the contact surface contacts the portion of the folding mechanism.

An example assembly consistent with any of the preceding nine paragraphs includes the folding mechanism comprising a first link having a first end pivotally connected with the first panel and pivotally connected with a first end of a second link. The second link has a second end configured to be pivotally connected near a bottom of an elevator car. The first link is the portion of the folding mechanism contacted by the contact surface.

An example assembly consistent with any of the preceding ten paragraphs includes a stop member near the first end of the second link. The stop member engages the first link near the second end of the first link. The stop member maintains a desired alignment of the first and second links when the first panel is in the extended position.

An example assembly consistent with any of the preceding eleven paragraphs includes the second panel pivoting with the first panel as the first panel moves between the extended position and the folded position.

An example assembly consistent with any of the preceding twelve paragraphs includes a bracket that is configured to be secured near a floor of an elevator car. The bracket includes a toe guard panel portion that is parallel to and aligned with the first and second panels when the first and second panels are in the extended positions.

An exemplary elevator system includes an elevator car that is moveable within a hoistway. A first toe guard panel is supported near a bottom of the elevator car. A second toe guard panel is slidable relative to the first panel in a first direction between an extended position and a retracted position. The first toe guard panel moves in a second, different direction from an extended position toward a folded position responsive to the second panel moving toward the retracted position.

In one example system consistent with the preceding paragraph, the first toe guard panel and the second toe guard panel extend over a first distance beneath the elevator car when the toe guard panels are both in the extended position. The first toe guard panel and the second toe guard panel extend over a second, smaller distance beneath the elevator car when the first toe guard panel is in the extended position and the second toe guard panel is at least partially in the retracted position. The first toe guard panel and the second toe guard panel extend over a third, smallest distance beneath the elevator car when the first toe guard panel is in the folded position.

In an example system consistent with the two previous paragraphs, the hoistway includes a pit having a depth. The first distance is greater than the pit depth and the third distance is less than the pit depth.

In an example system consistent with any of the three preceding paragraphs, the second panel is telescopically moveable relative to the first panel and the first panel is pivotally moveable relative to the elevator car.

In an example system consistent with any of the preceding four paragraphs, the second panel is supported beneath the first panel in the extended position. The second panel at least partially overlaps the first panel in the extended position and the retracted position. The second panel moves with the first panel as the first panel moves into the folded position.

An example system consistent with any of the preceding five paragraphs includes a contactor supported beneath the second toe guard panel. The contactor is configured to contact a surface near a bottom of the hoistway as the elevator car approaches the surface. The second panel moves from the extended position toward the retracted position responsive to that contact. The contactor moves along the surface as the first panel moves toward the folded position.

An example system consistent with any of the preceding six paragraphs includes a fixed bracket that is configured to be secured near a floor of the elevator car. The fixed bracket includes a fixed toe guard panel portion that is generally perpendicular to the floor of the elevator car. The first and second toe guard panels are parallel to an aligned with the fixed toe guard panel portion when the first and second panels are in the extended positions.

The various features and advantages of a disclosed example embodiment will become apparent to those skilled in the art from the following detailed description. The drawings that accompany the detailed description can be briefly described as follows.

DETAILED DESCRIPTION

Figure 1:
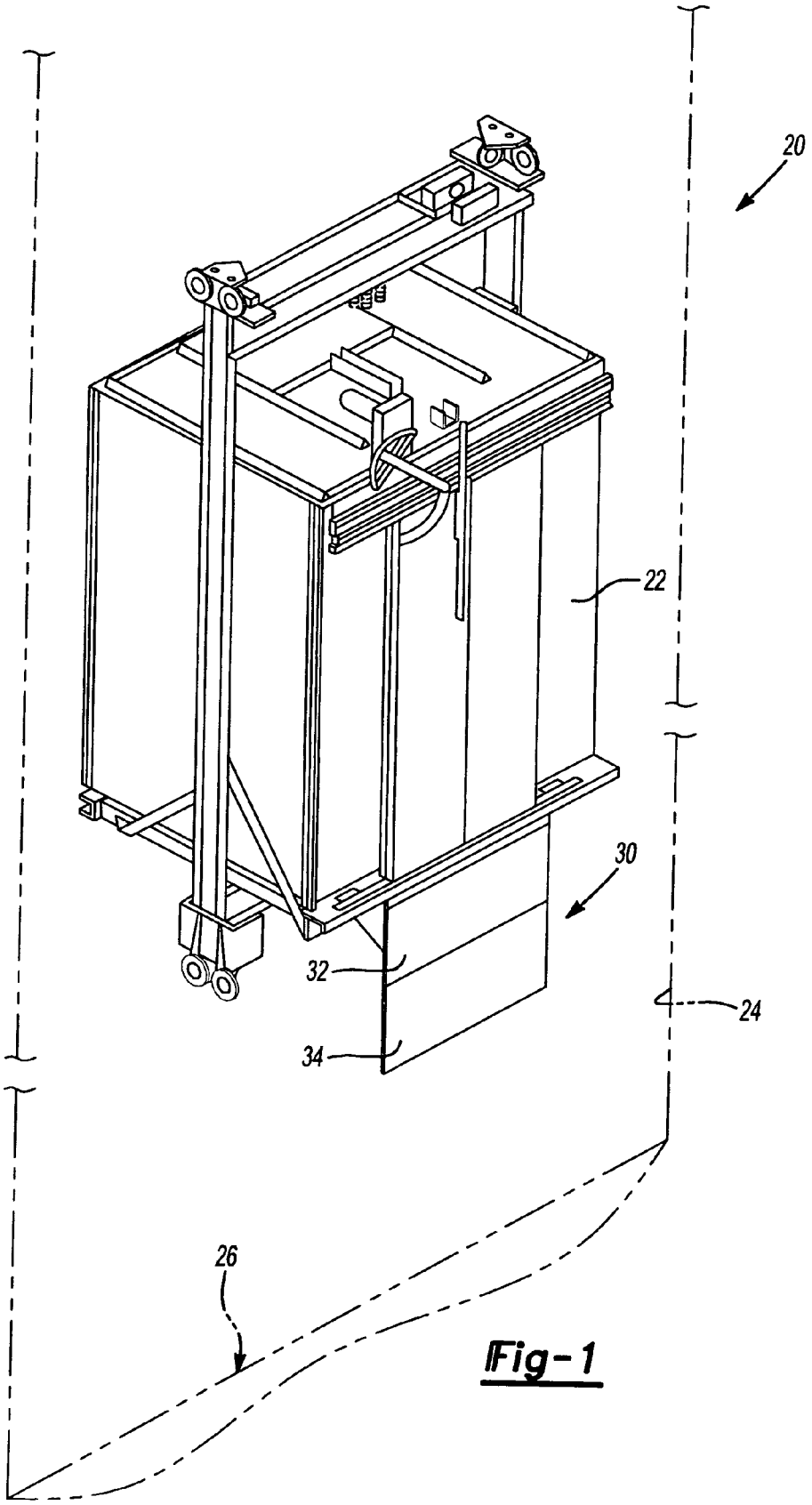
FIG. 1 schematically illustrates selected portions of an example elevator system including a toe guard assembly designed according to an embodiment of this invention.

FIG. 1 schematically shows selected portions of an elevator system 20. Only selected portions are illustrated. Those skilled in the art will realize that many other components (e.g., rails, buffers, governors, machines, brakes, drives, controllers, traction members, etc.) are included in an elevator system. Such components are omitted from the illustration and this discussion for the sake of brevity and because those skilled in the art are already aware of such components.

An elevator car 22 is moveable within a hoistway 24. A surface 26 near the bottom of the hoistway 24 may be the floor of the pit or a bottom hoistway surface in examples that do not include a pit at the bottom of the hoistway 24.

A toe guard assembly 30 is provided on the elevator car 22 to cover the space between a bottom of the elevator car 22 and an adjacent landing, if, for any reason, the hoistway doors (not shown) were to open before the car is properly aligned with the landing. The presence of the toe guard assembly 30 has an impact on how low the elevator car 22 can descend. The example toe guard assembly 30 is moveable from the extended position (shown in FIG. 1) into a retracted and folded position (shown in FIGS. 11 and 12) that allows the elevator car 22 to descend closer to the surface 26 than it otherwise would be able to if the toe guard assembly 30 remained in the position shown in FIG. 1.

Figure 2:
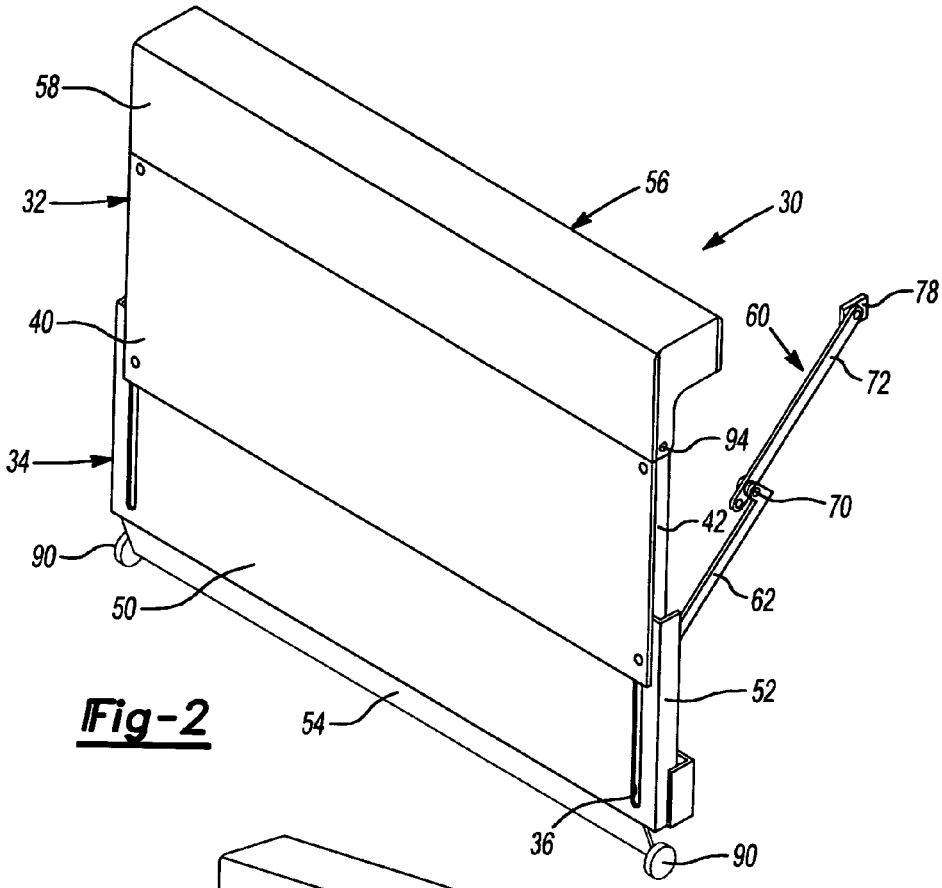
FIG. 2 is a diagrammatic, perspective illustration of an example toe guard assembly according to an embodiment of this invention.
Figure 3:
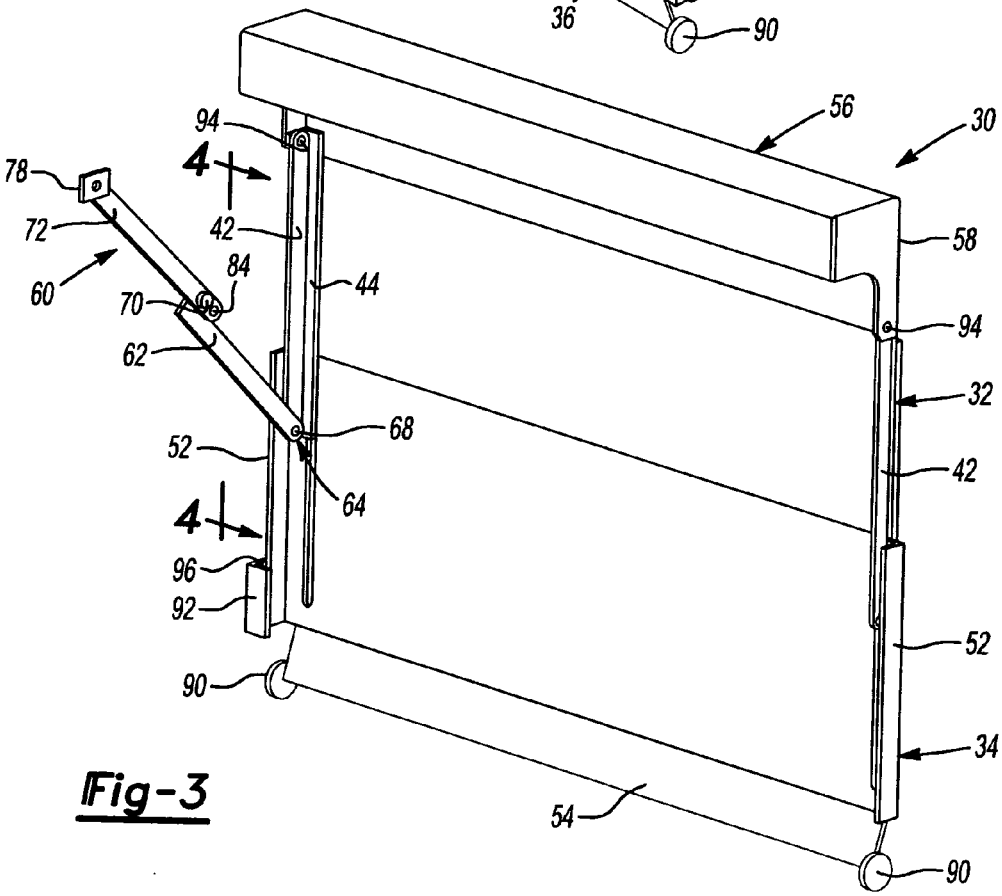
FIG. 3 is a diagrammatic, perspective illustration of the example of FIG. 2 from an opposite perspective.
Figure 4:
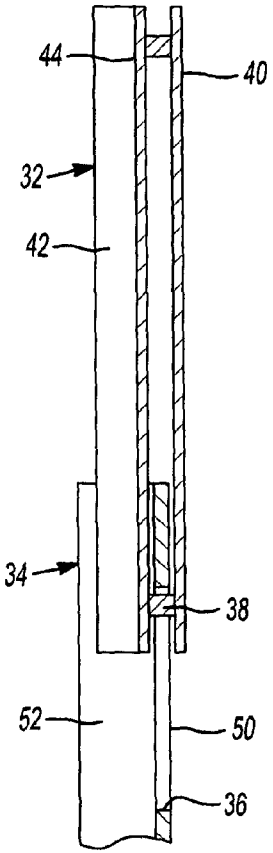
FIG. 4 is a cross-sectional illustration taken along the lines 4-4 in FIG. 3.

Referring to FIGS. 2-4, an example elevator toe guard assembly 30 includes a first panel 32 and a second panel 34. The second panel 34 is moveable in a first direction relative to the first panel 32 between an extended position (shown in FIGS. 2-4, for example) and a retracted position (shown in FIGS. 11 and 12, for example). In this example, the second panel 34 is slidable and telescopically moveable relative to the first panel 32. In this example, the second panel 34 includes slots 36. The first panel 32 includes posts 38 that are received within the slots 36. The posts 38 and the ends of the slots 36 establish a range of movement of the second panel 34 relative to the first panel 32.

As can best be appreciated from FIG. 4, the first panel 32 in this example includes a front plate 40, side flanges 42 and rear portions 44. The second panel 34 includes a front plate 50 and side flanges 52. As can be appreciated from the illustrations, the front plate 50 is received between the front plate 40 and the rear portions 44 of the first panel 32. The posts 38 provide spacing between the front plate 40 and the rear portions 44 to receive a corresponding section of the front plate 50 in a manner that allows the second panel 34 to move relative to the first panel 32. The side flanges 52 are received on the outside of the side flanges 42 in this example.

The second panel 34 is in a fully extended position in FIGS. 2-4. In this example, the fully extended position includes the second panel 34 being vertically at least partially beneath the first panel 32 with a bottom edge 54 at a lowest possible position furthest from the first panel 32.

The example toe guard assembly 30 includes a fixed bracket 56 having a toe guard panel 58 that is parallel to and aligned with the first panel 32 and the second panel 34 when those two panels are in their fully extended positions. The fixed bracket 56 is configured to be secured to an appropriate portion of the elevator car 22 so that the toe guard assembly 30 is situated in a desired position relative to the elevator car 22. The first panel 32 is connected to the fixed bracket 56 in this example.

The illustrated example also includes a folding mechanism 60 that facilitates movement of the first panel 32 in a second, different direction (compared to the sliding direction of movement of the second panel 34) responsive to movement of the second panel 34 toward the retracted position. As can be appreciated from FIGS. 2, 3 and 5, the folding mechanism 60 in this example includes a first link 62. One end 64 of the first link 62 is pivotally connected to the first panel 32 at a pivot point 68. An opposite end of the first link 62 is pivotally connected to a second link 72 at a pivot point 70. The pivotal connection at pivot point 70 is near a second end 74 of the first link 62. The second link 72 is pivotally connected at a pivot point 76 to a mounting bracket 78 that is secured to a platform 80 of the elevator car 22. The pivotal connection at pivot point 76 is near a second end 82 of the second link 72. A stop member 84 is supported on the second link 72 and contacts a surface on the first link 62 to maintain the links 62 and 72 in a desired orientation when the first panel 32 is in a fully extended position.

One feature of the example stop member 84 and the associated components of the folding mechanism 60 is that the toe guard assembly has a mechanical strength that satisfies code requirements. For example, the illustrated example complies with the requirements in EN81-21 regarding mechanical strength sufficient to resist without any permanent deformation and without any horizontal deformation greater than 35 mm responsive to a force of 300 N applied at a right angle to the toe guard over an area of 5 $cm^2$ in a round of square section.

Figure 6:
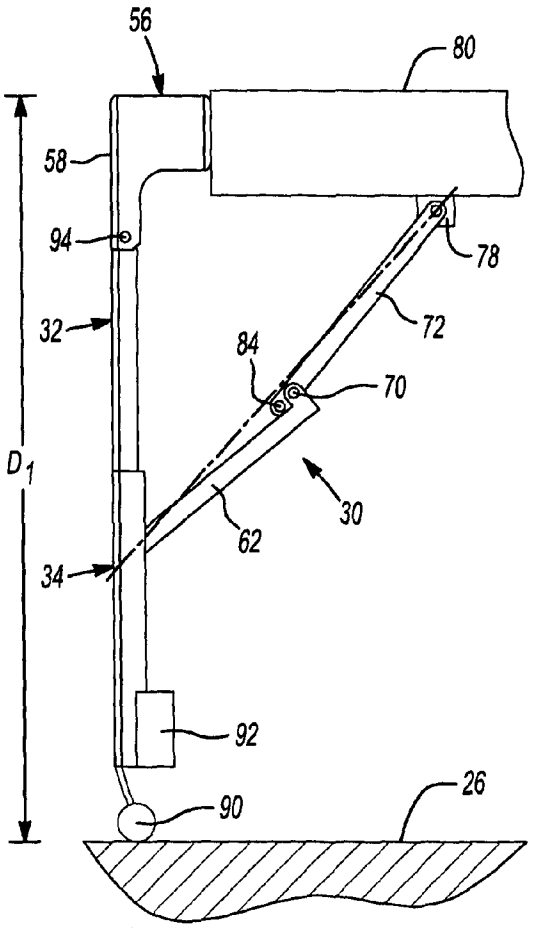
FIG. 6 shows the example of FIG. 5 in another operating condition in which a portion of the toe guard assembly contacts a lower surface in a hoistway.
Figure 5:
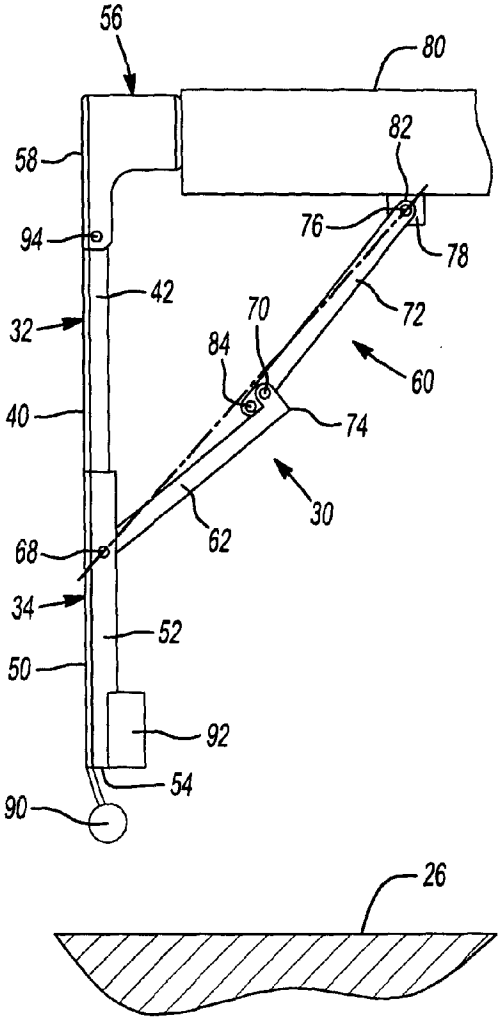
FIG. 5 schematically illustrates operation of an example toe guard assembly where the toe guard is in a fully extended position.

As shown in FIG. 5, the elevator car is approaching the lower surface 26 of the hoistway 24. The illustrated example includes a contactor 90 that extends beneath the lower surface 54 of the second panel 34. In the illustrated example, the contactor 90 comprises a roller. Other examples including sliding members or skates. The contactor 90 contacts the surface 26 once the elevator car 22 descends to a sufficiently low position. As shown in FIG. 6, the contactor 90 has contacted the surface 26. Continued movement of the elevator car in a downward direction results in the second panel 34 sliding upwardly relative to the first panel 32. It is also possible to consider this relative movement as the first panel 32 sliding downward relative to the second panel 34. For purposes of discussion, this movement is considered movement of the second panel 34 from a fully extended position (FIG. 5) toward a retracted position (FIG. 9).

Figure 7:
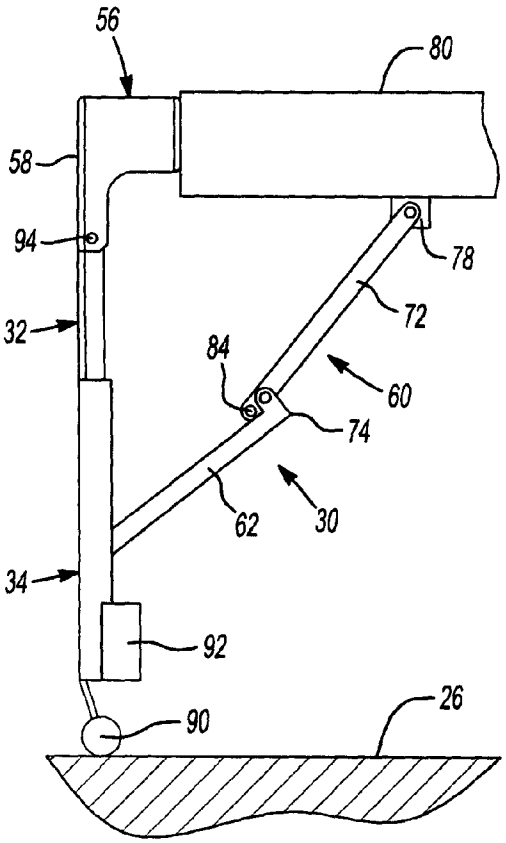
FIG. 7 shows the example of FIGS. 5 and 6 in another operating condition in which the elevator car is moved closer to the surface at the bottom of the hoistway compared to the view of FIG. 6.
Figure 9:
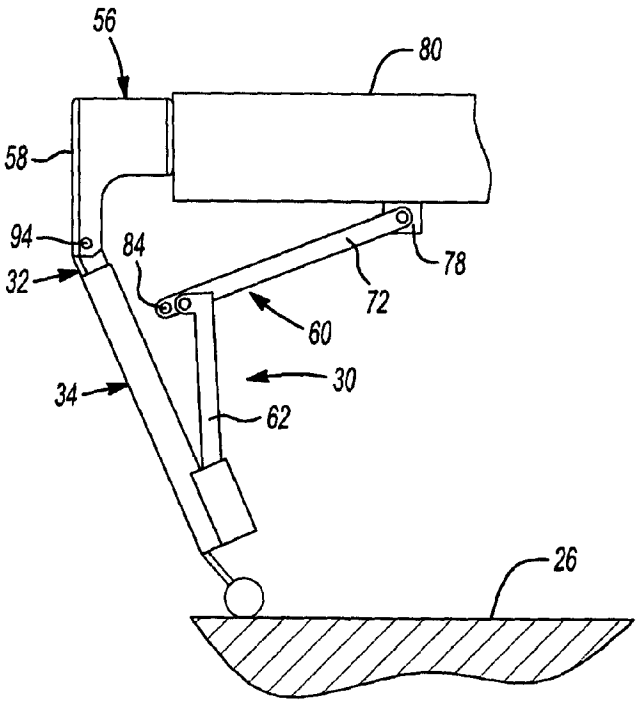
FIG. 9 illustrates the examples of FIG. 5-8 when the elevator car has descended further and more folding has occurred.

FIG. 7 schematically illustrates the second panel 34 approximately halfway between the fully extended position of FIGS. 5 and 6 and a fully retracted position (shown in FIG. 9, for example). As the elevator car 22 continues to descend, the second panel 34 continues to move relative to the first panel 32 toward the retracted position of the second panel 34.

Figure 8:
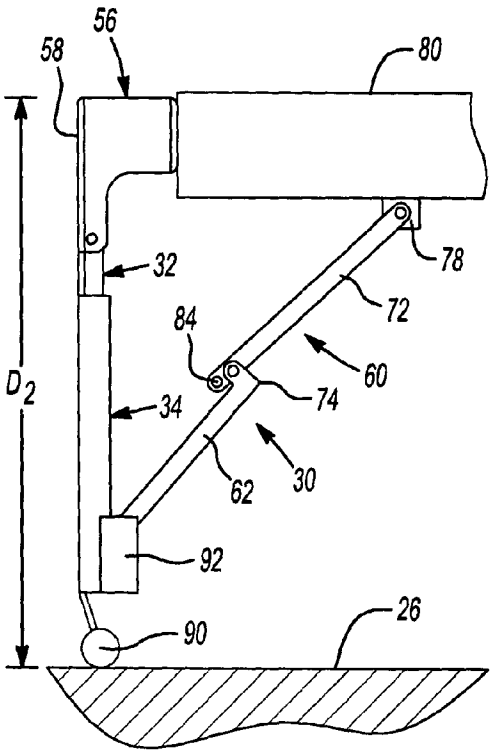
FIG. 8 shows the example of FIGS. 5-7 in a position where an instigator instigates movement of a folding mechanism.
Figure 11:
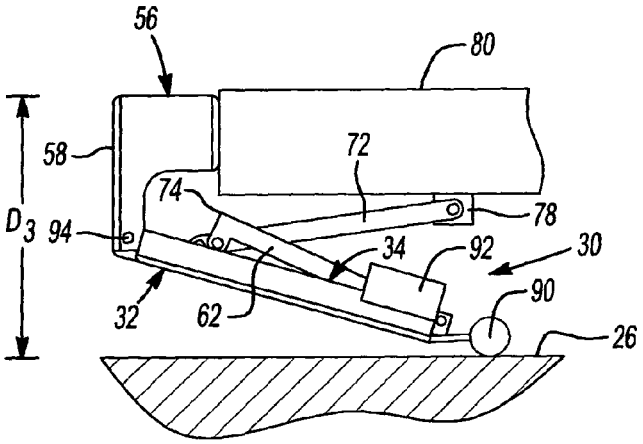
FIG. 11 shows the example of FIGS. 5-10 with the toe guard assembly panels in a retracted and folded position.
Figure 12:
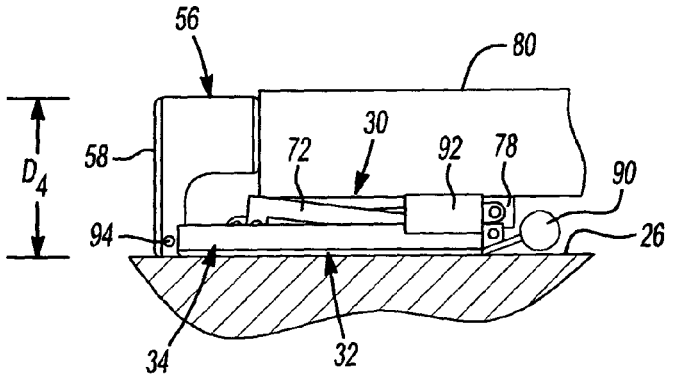
FIG. 12 shows the example of FIGS. 5-11 retracted and folded to a furthest extent.

As shown in FIG. 8, an instigator 92 supported on the second panel 34 contacts a portion of the first link 62 of the folding mechanism 60. In this example, such contact occurs before the second panel 34 has reached a fully retracted position. As the elevator car continues to descend (as can be appreciated by comparing FIGS. 8 and 9), the folding mechanism begins to fold because of the contact between the instigator 92 and the first link 62. The folding movement of the folding mechanism 60 urges the first panel 32 out of its extended position (shown in FIGS. 5-8, for example) toward a folded position. In this example, the folded position includes the first panel 32 being beneath the elevator car at an oblique angle relative to the platform 80 (as shown in FIG. 11, for example) or generally horizontal to the platform 80 (as shown in FIG. 12, for example). During the continued descent of the elevator car, the contactor 90 moves along the surface 26 as the first panel 32 continues to move toward the folded position.

In this example, one end of the first panel 32 is pivotally connected to the fixed bracket 56 at a pivot point 94. The first panel 32 in this example pivots about the pivot point 94 as it moves between the extended and folded positions. In this example, the second panel 34 moves with the first panel 32 as the first panel 32 moves between the extended and folded positions.

Figure 10:
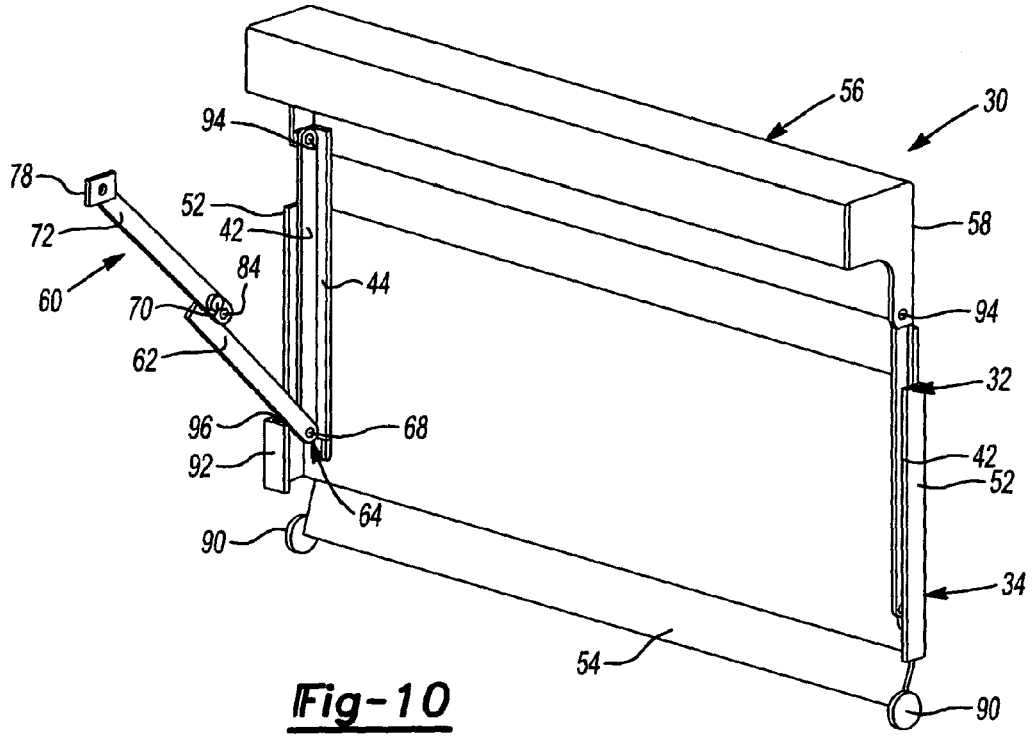
FIG. 10 is a diagrammatic, perspective illustration from an underside of the elevator car showing a backside of the toe guard assembly and an interaction between an instigator and the example folding mechanism.

FIG. 10 shows one example configuration of the instigator 92. In this example, the instigator 92 comprises a bracket that is supported on the second panel 34. A contact surface 96 on the instigator 92 contacts a portion of the first link 62 as the second panel 34 moves vertically and telescopically relative to the first panel 32 responsive to a continued descent of the elevator car 22.

FIG. 11 shows one example in a fully folded position where the platform 80 has reached a lowest desired position within the hoistway relative to the surface 26. In one example, the arrangement shown in FIG. 11 provides a sufficient position of the platform 80 so that the floor of the elevator car is at a position corresponding to a lowest landing serviced by that elevator car. As can be appreciated from FIG. 11, the first and second panels 32 and 34 are at an oblique angle relative to the platform 80.

In the position shown in FIG. 6, the first panel 32 and the second panel 34 extend beneath the platform 80 of the elevator car over a first distance D1. In the position shown in FIG. 8 in which the second panel 34 is approaching a fully retracted position relative to the first panel 32, the first panel 32 and the second panel 34 extend beneath the platform 80 over a second, smaller distance D2. In the position shown in FIG. 11, for example, the first panel 32 and the second panel 34 are positioned beneath the platform 80 extending over a third, smaller distance D3. In one example, the distance D3 is approximately 280 millimeters. The illustrated arrangement allows for accommodating a variety of pit depths in an elevator system. Additionally, the illustrated arrangement is useful within elevator systems that do not include a pit.

FIG. 12 shows the position of the toe guard assembly 30 in which the first panel 32 and the second panel 34 are generally parallel to the platform 80. As a result, the first panel 32 and the second panel 34 are positioned beneath the platform extending over a fourth, smallest distance D4. This condition exists in one example when the elevator car has descended far enough to compress buffers beneath the elevator car such that the elevator car is in an absolute lowest possible position relative to the surface 26. It is possible to configure the toe guard assembly 30 so that the fully folded position always corresponds to the orientation shown in FIG. 12. It is also possible to configure the toe guard assembly 30 so that a fully folded position corresponds to the arrangement shown in FIG. 11. Given this description, those skilled in the art will realize how the components should be arranged in a fully extended and fully folded position to meet the needs of their particular situation.

A disclosed example provides a unique toe guard assembly having more than one panel that is moveable relative to the elevator car. The illustrated example includes a first panel that is pivotally moveable or foldable relative to the elevator car. A second panel is slidably or telescopically moveable relative to the first panel. Additionally, the movement of the first panel occurs responsive to movement of the second panel toward a retracted position of the second panel relative to the first panel. This provides a unique arrangement of a toe guard assembly that allows for an elevator car to be moveable within a hoistway even when there is a shallow pit depth or no pit at all.

The preceding description is exemplary rather than limiting in nature. Variations and modifications to the disclosed examples may become apparent to those skilled in the art that do not necessarily depart from the essence of this invention.

The scope of legal protection given to this invention can only be determined by studying the following claims.

We claim:

1. An elevator system, comprising:

a hoistway;

an elevator car that is moveable within the hoistway;

a first toe guard panel supported near a bottom of the elevator car;

a second toe guard panel that is slidable relative to the first panel in a first direction between an extended position and a retracted position, the first toe guard panel moving in a second, different direction from an extended position toward a folded position responsive to the second panel moving toward the retracted position;

a folding mechanism that facilitates the first panel moving between the extended position and the folded position; and an instigator supported on the second panel, the instigator instigating folding the folding mechanism, wherein the instigator comprises a contact surface that moves from a non-contact position into a contact position where the contact surface contacts a portion of the folding mechanism as the second panel moves relative to the first panel, the contact resulting in the portion of the folding mechanism urging the first panel toward the folded position.

2. The system of claim 1, wherein the first toe guard panel and the second toe guard panel (i) extend over a first distance beneath the elevator car when the toe guard panels are both in the extended position, (ii) extend over a second, smaller distance beneath the elevator car when the first toe guard panel is in the extended position and the second toe guard panel is at least partially in the retracted position, and (iii) extend over a third distance beneath the elevator car when the first toe guard panel is in the folded position, the third distance is smaller than the second distance.

3. The system of claim 2, wherein the hoistway includes a pit having a depth, the first distance is greater than the pit depth and the third distance is less than the pit depth.

4. The system of claim 1, wherein the second panel is telescopically moveable relative to the first panel and the first panel is pivotally moveable relative to the elevator car.

5. The system of claim 4, wherein the second panel is supported at least partially vertically beneath the first panel in the extended position, the second panel at least partially overlaps the first panel in the retracted position and the second panel moves with the first panel as the first panel moves into the folded position.

6. The system of claim 1, comprising a contactor supported beneath the panels, the contactor being configured to contact a surface near a bottom of the hoistway as the elevator car approaches the surface, the second panel moving from the extended position toward the retracted position responsive to the contact, the contactor moving along the surface as the first panel moves toward the folded position.

7. The system of claim 1, comprising a fixed bracket that is configured to be secured near a floor of the elevator car, the fixed bracket including a fixed toe guard panel portion that is generally perpendicular to the floor of the elevator car, the first and second toe guard panels being parallel to and aligned with the fixed toe guard panel portion when the first and second panels are in the extended positions.

8. An elevator toe guard assembly, comprising:

a first panel;

a second panel that is slidable relative to the first panel in a first direction between an extended position and a retracted position, the first panel moving in a second, different direction from an extended position toward a folded position responsive to the second panel moving toward the retracted position;

a folding mechanism that facilitates the first panel moving between the extended position and the folded position; and an instigator supported on the second panel, the instigator instigating folding the folding mechanism, wherein the instigator comprises a contact surface that moves from a non-contact position into a contact position where the contact surface contacts a portion of the folding mechanism as the second panel moves relative to the first panel, the contact resulting in the portion of the folding mechanism urging the first panel toward the folded position.

9. The assembly of claim 8, wherein the second panel is telescopically moveable relative to the first panel and the second panel moves with the first panel in the second direction.

10. The assembly of claim 8, wherein the second panel is supported at least partially vertically beneath the first panel in the extended position and at least partially overlaps the first panel in the retracted position.

11. The assembly of claim 8, comprising a contactor supported beneath the panels, the contactor being configured to contact a surface beneath the panels as the assembly moves vertically downward, the second panel moving from the extended position toward the retracted position responsive to the contact.

12. The assembly of claim 8, wherein the first panel is pivotally supported near a first end of the first panel and a folding mechanism is connected to the first panel near a second, opposite end of the first panel, the first panel pivoting about a pivot point near the first end when moving between the extended and folded positions.

13. The assembly of claim 8, wherein the contact surface is at least partially transverse to the first direction and the contact surface is near one end of the second panel such that the contact surface contacts the portion of the folding mechanism as the second panel approaches the retracted position.

14. The assembly of claim 13, wherein the contact surface is situated on the second panel such that the second panel continues to move into the retracted position after the contact surface contacts the portion of the folding mechanism.

15. The assembly of claim 8, wherein the folding mechanism comprises a first link having a first end pivotally connected with the first panel and a second end pivotally connected with a first end of a second link, the second link having a second end configured to be pivotally connected near a bottom of an elevator car, and wherein the first link is the portion of the folding mechanism contacted by the contact surface.

16. The assembly of claim 15, wherein the second link includes a stop member near the first end of the second link, the stop member engaging the first link near the second end of the first link, the stop member maintaining a desired alignment of the first and second links when the first panel is in the extended position.

17. The assembly of claim 8, wherein the second panel pivots with the first panel as the first panel moves between the extended position and the folded position.

18. The assembly of claim 8, comprising a bracket that is configured to be secured near a floor of an elevator car, the bracket including a toe guard panel portion that is parallel to and aligned with the first and second panels when the first and second panels are in the extended positions.

* * * * *